US010144018B2

(12) United States Patent
Ganzeboom

(10) Patent No.: US 10,144,018 B2
(45) Date of Patent: Dec. 4, 2018

(54) STORAGE HOLDER FOR A DISPENSER

(71) Applicant: GAB Engineering & Development B.V., Haarlem (NL)

(72) Inventor: Wilhelmus Everhardus Ganzeboom, Haarlem (NL)

(73) Assignee: GAB Engineering & Development B.V., Haarlem (NL)

( * ) Notice: Subject to any disclaimer, the term of this patent is extended or adjusted under 35 U.S.C. 154(b) by 3 days.

(21) Appl. No.: 15/342,180

(22) Filed: Nov. 3, 2016

(65) Prior Publication Data

US 2017/0120268 A1 May 4, 2017

(30) Foreign Application Priority Data

Nov. 4, 2015 (NL) ..... 2015724

(51) Int. Cl.

| | |
|---|---|
| ***B05B 7/00*** | (2006.01) |
| ***A47K 5/12*** | (2006.01) |
| ***B65D 83/00*** | (2006.01) |
| ***A47K 5/14*** | (2006.01) |
| ***B05B 11/00*** | (2006.01) |

(52) U.S. Cl.

CPC ..... *B05B 7/0018* (2013.01); *A47K 5/12* (2013.01); *A47K 5/1204* (2013.01); *A47K 5/1211* (2013.01); *A47K 5/14* (2013.01); *B05B 11/3043* (2013.01); *B65D 83/00* (2013.01)

(58) Field of Classification Search

CPC ..... B05B 7/0018; B05B 11/3043; A47K 5/14; A47K 5/1204; A47K 5/1211; A47K 5/12; B65D 83/00

See application file for complete search history.

(56) References Cited

U.S. PATENT DOCUMENTS

| | | | | |
|---|---|---|---|---|
| 8,336,740 | B1 | 12/2012 | Daansen | |
| 2005/0006408 | A1 | 1/2005 | Ganzeboom | |
| 2013/0105519 | A1* | 5/2013 | Sundberg | A47K 5/14 222/153.13 |

OTHER PUBLICATIONS

Search Report in Netherlands Patent Application No. 2015724, dated Aug. 11, 2016.

* cited by examiner

*Primary Examiner* — Donnell Long
(74) *Attorney, Agent, or Firm* — Fitzpatrick, Cella, Harper & Scinto

(57) ABSTRACT

A storage holder for placement in a liquid or foam dispenser includes a liquid reservoir having an opening and a plug provided in the opening. The storage holder also includes a pump having a pump section and an inlet tube extending from the pump section. The storage holder further includes a spacer having an opening for the inlet tube, with the spacer being positioned between the pump section and the plug so that a defined distance is provided between the pump section and the plug. The spacer is fixed at a position relative to the plug and relative to the pump only by a clamping connection between the inlet tube and the plug. The spacer is not connected to the pump and the spacer is not connected to the plug such that spacer may be separated from the pump and the plug when the pump is pulled out of the plug.

10 Claims, 3 Drawing Sheets

STORAGE HOLDER FOR A DISPENSER

The present application claims priority under 35 U.S.C. § 119 to Netherlands Patent Application No. 2015724, filed Nov. 4, 2015, which is incorporated by reference in its entirety.

FIELD OF THE INVENTION

The invention is directed to a storage holder, destined for placement in a liquid or foam dispenser. The invention is also directed to a liquid or foam dispenser and to a method for disassembling a storage holder.

BACKGROUND OF THE INVENTION

US2005/0006408 describes a storage holder destined for placement in a foam dispenser. The storage holder described in this publication consisted of a liquid reservoir, a foam pump and a coupling piece. The liquid reservoir has an opening provided with a plug. The coupling piece connects the foam pump to the plug, wherein the foam pump is screwed to the coupling piece. The coupling piece in turn is provided with a connecting element to connect the storage holder to the foam dispenser.

A disadvantage of the storage holder of US2005/0006408 is that it is difficult to accurately position the foam pump to the coupling piece by means of screwing. It is important that the outlet for foam of the foam pump and the means to connect the storage holder to the foam dispenser are correctly positioned relative to each other. If this is not performed accurately the outlet for foam may not be in its operational position once the storage holder is placed in the foam dispenser.

The present inventions aims to provide a storage holder which does not have this disadvantage.

SUMMARY OF THE INVENTION

The invention is directed to a storage holder, destined for placement in a liquid or foam dispenser, comprising a liquid reservoir, a pump and a spacer, wherein the liquid reservoir has an opening, which opening is provided with a plug which plug is provided with an opening, the pump is provided with a pump section and a inlet tube extending from the pump section and having a smaller cross section than the pump section, which inlet tube is fixed into the opening of the plug by a clamping connection, and the spacer is provided with an opening for the inlet tube and at its exterior a means to couple the storage holder to the liquid or foam dispenser, wherein the spacer is positioned between the pump section and the plug to achieve a defined distance between pump section and plug and wherein the spacer is fixed into position relative to the plug and relative to the pump only by the clamping connection between inlet tube and plug.

The invention is also directed to a liquid or foam dispenser comprising a housing and a storage holder according to the invention, wherein the storage holder is fastened to the housing with the means to couple the storage holder to the liquid or foam dispenser.

The invention is also directed to a method of disassembling a storage holder, destined for placement in a liquid or foam dispenser, comprising a liquid reservoir, a pump and a spacer, wherein the liquid reservoir has an opening, which opening is provided with a plug which plug is provided with an opening, the pump is provided with a pump section and an inlet tube extending from the pump section and having a smaller cross section than the pump section, which inlet tube is fixed into the opening of the plug by a clamping connection, and the spacer is provided with an opening for the inlet tube and at its exterior a means to couple the storage holder to the liquid or foam dispenser, wherein the spacer is positioned between the pump section and the plug to achieve a defined distance between pump section and plug and wherein the spacer is fixed into position relative to the plug and relative to the pump only by the clamping connection between inlet tube and plug and wherein the disassembling is performed by pulling the pump from the plug resulting in that the spacer is obtained as a separate part without having to exert any additional force.

Applicants found that when assembling the storage holder according to the invention it is easier to position the pump relative to the means to couple the storage holder to the liquid or foam dispenser. Only the outlet for foam or liquid soap needs to be positioned correctly into the plug. The spacer and its means to couple the storage holder to the liquid or foam dispenser can either freely move when positioning the storage holder or are fixed in a more simple manner. This simplifies the assembly of the storage holder significantly. Another advantage is that the outflow opening of the pump can be easily positioned when or after placing the storage holder in a foam or liquid dispenser. This feature is advantageous because it means that the positioning when manufacturing the storage holder is less critical. A further advantage is that when disassembling the storage holder one only has to pull the pump from the plug to obtain the liquid reservoir, spacer and pump as separate parts. This enables one to recycle, clean and/or reuse these parts separately.

DETAILED DESCRIPTION OF THE INVENTION

Figure 1:
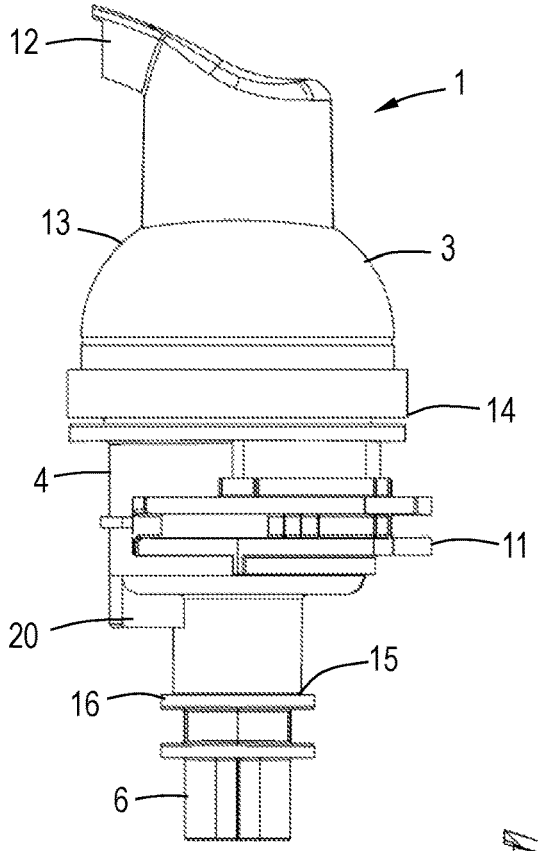
FIG. 1 shows part of a storage holder according to the invention.

The storage holder according to the invention will be described in more detail below. The spacer is provided with an opening for the inlet tube and at its exterior a means to couple the storage holder to the liquid or foam dispenser. The opening in the spacer is for passage of the liquid or foam from the liquid reservoir to the pump. The liquid or foam will flow through this opening via the inlet tube of the pump and optionally other parts of the pump if such parts are positioned in the opening.

The means to couple the storage holder to the dispenser and the spacer may be one structural part or be separate connected parts. The advantage of using separate parts is that the assembled storage holder can be easily adapted for different designs of liquid or foam dispensers by simply replacing the means to couple the storage holder with a different means to couple the storage holder to another liquid or foam dispenser.

The spacer may be made of any kind of material. Preferably the spacer is made of a polymer material. Polymer materials are preferred because they can be easily fabricated and recycled. Examples of suitable materials are thermoplastic polymers preferably polypropylene and polyethylene. An optional separate means to couple the storage holder to the dispenser is suitably made of the same material such to enable a more simple recycling process where both parts do not need to be separated.

The pump may be any liquid or foam pump provided it is provided with a with a pump section and an inlet tube extending from the pump section and having a smaller cross section than the pump section. Such pumps are well known for hand soap dispensers and hand foam dispensers as positioned on top of a bottle. The inlet tube suitably has a tubular exterior design. This enables on to easily position the tube in the opening of the plug. The pump is suitably operated by the muscular energy of the operator at the moment of use. It may be a liquid pump or a pump which combines liquid and air to create a foam.

The pump is suitably a piston pump wherein the pump comprises a pump section comprising a moveable operating part comprising a liquid piston, an optional air piston and a nozzle for dispensing a liquid or foam and a fixed part comprising of the inlet tube fluidly connected to a liquid chamber and optional air chamber positioned around the liquid chamber, wherein the fixed part further comprises of a cap through which the nozzle extends from the liquid or foam pump and which cap has a larger cross section that the inlet tube and which cap has a side which rests on the spacer. Preferably pumps are used which are manufactured in large series for use on top of bottles. Such pumps will be provided with a cap with which the pump can be fixed to the bottle. Connection between the cap and bottle is typically achieved by means of a screw connection or by means of a snap connection. In the storage holder according to the invention no use is made of such connection means even if they are present in the commercially available pumps used in combination with the storage holder. Instead the cap, if present, rests onto the spacer and is not directly fixed to the spacer.

The pump may be a liquid pump or a foam pump. Examples of suitable liquid and foam pumps are described in U.S. Pat. No. 3,359,917, U.S. Pat. No. 5,271,530, EP0544549, U.S. Pat. No. 5,443,569, US2002000452, U.S. Pat. No. 6,290,145, US2003082243, US2001042761, US2002070238, US2004069807, US2004000567, US2004084481, US2006151538, US2005067435, U.S. Pat. No. 7,004,356B, US2006283887, US2006246013, US2007045350, US2011168739, WO07083206, US2008093386, US2008118368, US2008268188, US2009062176, US2010314417, US2011297700, GB2484092, US2012104048, US2014097209, WO14119102, U.S. Pat. No. 6,053,364, U.S. Pat. No. 5,110,271, U.S. Pat. No. 5,190,192, U.S. Pat. No. 5,176,296, U.S. Pat. No. 6,053,364, U.S. Pat. No. 5,725,128, US2003197034, US2010038383.

The side of the pump section facing the reservoir may be provided with a male or female part and the spacer is provided with a corresponding female respectively male part. Male and female part are such that when assembled the male part sits within the female part and avoids rotation of the spacer relative to the pump.

In a preferred embodiment the pump is a foam pump. Such a foam pump suitably comprises a pump section comprising a moveable operating part comprising a liquid piston, an air piston and a nozzle for dispensing a foam and a fixed part comprising of the inlet tube fluidly connected to a liquid chamber and an air chamber positioned around the liquid chamber. The fixed part further comprises of a cap through which the nozzle extends from the liquid or foam pump and which cap has a larger cross section that the inlet tube. The cap has a side, facing the reservoir, which rests on the spacer. If the pump is a foam pump it is preferred that air can be sucked in by the air piston. For this reason the spacer is preferably provided with openings which fluidly connect the exterior of the storage holder with the inlet of the air piston. The opening of the spacer suitably encompasses part of the plug, part of the inlet tube and part of the optional air chamber.

The liquid reservoir may be any container suitably to hold a liquid. Preferably the liquid reservoir is a reservoir having a flexible wall. This is advantageous because when liquid is discharged from the reservoir via the pump no replacement air is required to be added to the reservoir in order to avoid a vacuum. The reservoir having a flexible wall is preferably made of a thermoplastic polymer such as polypropylene or polyethylene.

The plug is provided in an opening of the fluid reservoir. When a flexible polymer reservoir is used it is preferred to combine such a reservoir with a plug manufactured from the same material. Suitably a polypropylene reservoir is combined with a polypropylene plug and a polyethylene reservoir is combined with a polyethylene plug. Such combinations are preferably fixed by means of welding wherein by means of a heat treatment the connection is achieved by inter-melting the surfaces of the reservoir and plug.

The plug suitably has a tubular opening in which the inlet tube of the pump is fixed by a clamping connection. The plug may comprise a tubular part having an co-axial tubular opening wherein at the exterior of the tubular part a rim is present. The spacer may rests onto such a rim and is not directly fixed to the rim of the plug. Suitably a resilient means like a spring is present which forces the spacer onto the cap of the pump from a base present on the plug. This resilient means avoids friction between pump and the liquid or foam dispenser. The avoidance of such friction is advantageous because the pump will then be able to function over a larger period of operation without failure.

The rim of the plug may be positioned at the end of the tubular part. Preferably part of the tubular part extends from the rim into the space encompassed by the spacer. This results in a stable assembly, wherein the inlet tube is present within the tubular part and part of the spacer is present at the exterior of the tubular part for some distance up and to the rim of the plug. That part of the spacer preferably has a cylindrical opening for entry of the tubular part of the plug such that free movement of the spacer relative to the plug is possible.

The tubular shaped plug may also be provided with two extension surfaces extending radially outward at either side of the tubular body of the plug. These two surfaces are in one plane and form an anchor for the plug when connected with the flexible fluid reservoir. Preferably the plug and its extension surfaces are positioned in a larger opening of a reservoir having a flexible wall. By sandwiching the extension surfaces and tubular plug body within two surfaces of the flexible reservoir and welding the resulting sandwiched layers a closed reservoir may be obtained provided with the plug in the opening of the reservoir. Preferably the plug and fluid reservoir are made of the same material, for example both made of polyethylene or both made of polypropylene to obtain a strong welded connection.

The invention is also directed to a fluid or foam dispenser comprising a housing and a storage holder according to the invention. Suitable dispensers have a housing in which the comprising a rear body which is suited to be fixed to a vertical wall and a front cover, optionally pivotally engaged to the rear body along a horizontal axis. Between the rear body and the front cover a space is defined for the storage holder according to this invention. The storage holder is fastened to the housing with the means to couple the storage holder to the liquid or foam dispenser. Preferably the storage holder is engaged with the fluid or foam dispenser at the lower end of the above referred to space. The dispenser will at that position be provided with means for engaging with the means to couple the storage holder to the liquid or foam dispenser. Suitable storage holders will have some sort of means to actuate the liquid or foam pump by muscular energy and preferably some resilient means to bring the pump back to its closed position. The latter to avoid leakage. Examples of suitable fluid and foam dispensers are described in U.S. Pat. No. 7,611,033, U.S. Pat. No. 5,445,288, U.S. Pat. No. 5,638,989, U.S. Pat. No. 6,082,586, US2002005414, US2005205608, US2011127290, US2013105519.

The invention is also directed to a method of disassembling a storage holder, destined for placement in a liquid or foam dispenser, comprising a liquid reservoir, a pump and a spacer, wherein the liquid reservoir has an opening, which opening is provided with a plug which plug is provided with an opening, the pump is provided with a pump section and an inlet tube extending from the pump section and having a smaller cross section than the pump section, which inlet tube is fixed into the opening of the plug by a clamping connection, and the spacer is provided with an opening for the inlet tube and is positioned between the pump section and the plug to achieve a defined distance between pump section and plug and wherein the spacer is fixed into position relative to the plug and relative to the pump only by the clamping connection between inlet tube and plug and wherein the disassembling is performed by pulling the pump from the plug resulting in that the spacer is obtained as a separate part without having to exert any additional force such to separate the spacer from the pump and from the plug.

DETAILED DESCRIPTION OF THE FIGURES

Figure 2:
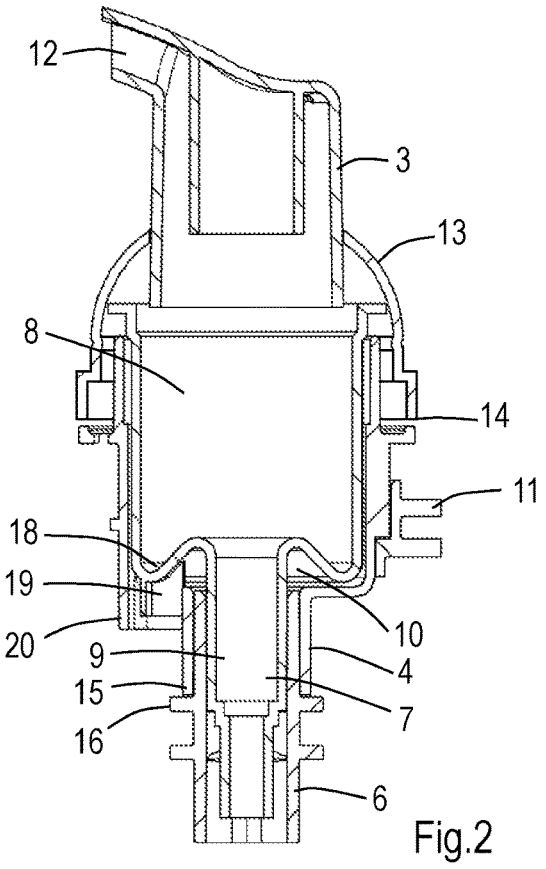
FIG. 2 shows a cross-sectional view of the storage holder of FIG. 1.

FIGS. 1 and 2 shows a storage holder 1 according to the invention. FIG. 2 is a cross-sectional view of the storage holder shown in FIG. 1. FIGS. 1 and 2 show a pump 3 and a spacer 4. FIGS. 1 and 2 do not show the liquid reservoir. Shown is only a plug 6 which will be provided in an opening of such a reservoir. Plug 6 is provided with an opening 7. Pump 3 is provided with a pump section 8 and an inlet tube 9 extending from the pump section 8. Inlet tube 9 has a smaller cross section than the pump section 8. The inlet tube 9 is fixed into the opening 7 of the plug 6 by a clamping connection. The spacer 4 is provided with an opening 10 for the inlet tube 9 and at its exterior a means 11 to couple the storage holder 1 to the liquid or foam dispenser. The opening 7 is a cylindrical opening and the exterior surface of the inlet tube 9 can form a clamping connection. Because of the tubular shape rotation is possible even after placing the inlet tube 9 into opening 7.

Pump 3 comprises a moveable operating part comprising a liquid piston, an optional air piston as present within the pump section 8 and a nozzle 12 for dispensing a liquid or foam. The fixed part of pump 3 comprises of the inlet tube 9 fluidly connected to a liquid chamber and optional air chamber positioned around the liquid chamber as present in the pump section 8. The fixed part further comprises of a cap 13 through which the nozzle 12 extends from the pump 3. As shown the cap 13 has a larger cross section that the inlet tube 9. The side 14 of cap 13 rests on the spacer 4. At its opposite end 15 the spacer 4 rests on a rim 16 of the plug 6.

The side 18 of the pump section 8 facing the reservoir 2 is provided with a male part 19. The spacer 4 is provided with a corresponding female part 20 which when positioned avoid rotation of the spacer 4 relative to the pump 3.

The pump 3 as shown may be a pump as described in more detail in U.S. Pat. No. 6,053,364, which publication is hereby incorporated by reference.

Figure 3:
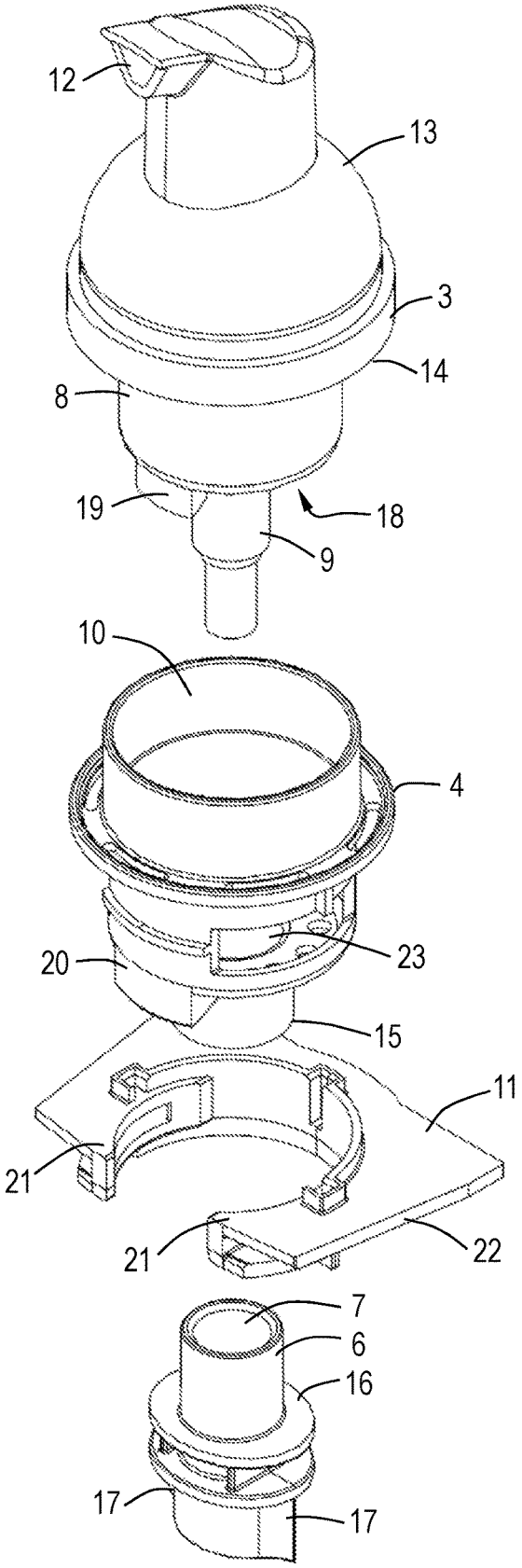
FIG. 3 shows the separate parts of the storage holder of FIG. 1.
Figure 4:
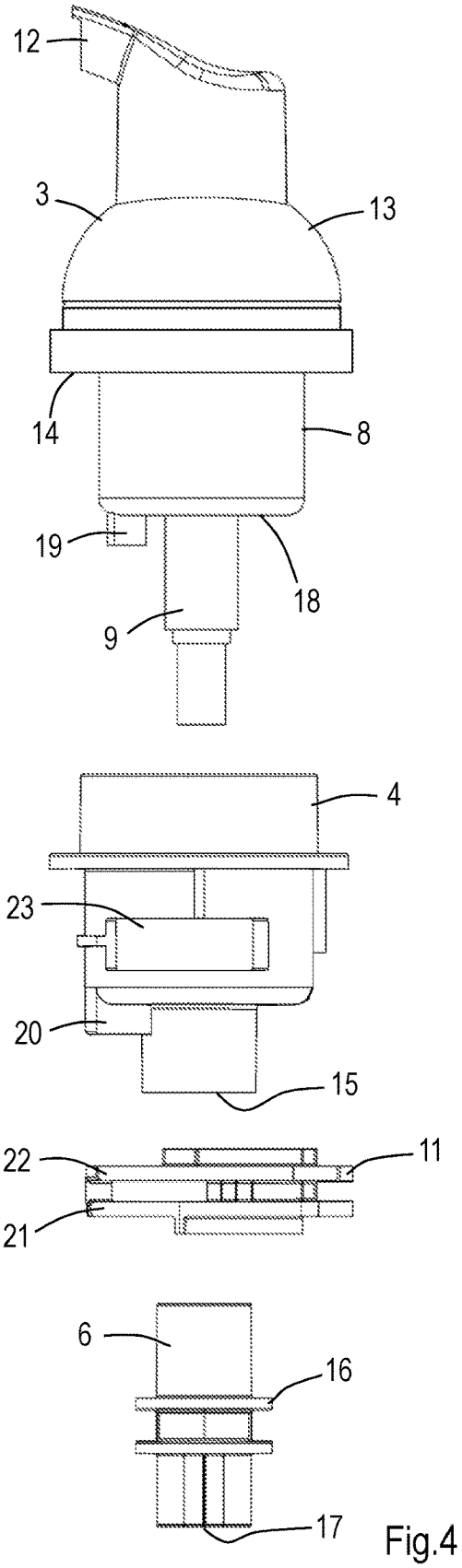
FIG. 4 shows the separate parts of the storage holder of FIG. 1.

FIGS. 3 and 4 shows the parts of the storage holder illustrated in FIGS. 1 and 2 as separate parts. Shown is the pump 3, spacer 4, means 11 to couple the storage holder 1 to the liquid or foam dispenser and plug 6. Means 11 can be assembled to spacer 4 by means of a snap connection wherein flexible arms 21 of means 11 interlock with opening 21 of spacer 4. Means 11 is also provided with a trapezium shaped rim 22 which is used to couple the storage holder to the liquid or foam dispenser.

When pump 3 is pulled from the opening 7 of plug 6 the assembly of spacer 4 and means 11 will not be connected to either pump 3 or plug 6 and simply will be obtained as a separate part.

Also shown are two surfaces 17 which extend from plug 6 to enable a strong, preferably welded, connection between the flexible reservoir and the plug.

The invention claimed is:

1. A storage holder for placement in a liquid or foam dispenser, the storage holder comprising:

a liquid reservoir having an opening and a plug provided in the opening;

a pump including a pump section and an inlet tube extending from the pump section; and a spacer including an opening for the inlet tube, the spacer being positioned between the pump section and the plug so that a defined distance is provided between the pump section and the plug, wherein the inlet tube is fixed in the plug by a clamping connection, wherein the spacer is fixed at a position relative to the plug and relative to the pump only by the clamping connection between the inlet tube and the plug, and wherein the spacer is not connected to the pump and the spacer is not connected to the plug such that spacer may be separated from the pump and the plug when the pump is pulled out of the plug.

2. A storage holder according to claim 1, wherein the spacer includes coupling means for coupling the storage holder to the liquid or foam dispenser, and wherein the coupling means includes separate connected parts.

3. A storage holder according to claim 1, wherein the spacer includes coupling means for coupling the storage holder to the liquid or foam dispenser, and wherein the spacer and the coupling means are made from polyethylene or polypropylene.

4. A storage holder according to claim 1, wherein a side of the pump section facing the liquid reservoir is provided with a male or female part, and the spacer is provided with a corresponding other of the male and female part such that when the male part is positioned to the female part the spacer is prevented from rotating relative to the pump.

5. A storage holder according to claim 1, wherein the pump is a foam pump provided with a liquid piston and an air piston, and wherein the spacer is provided with openings fluidly connecting an exterior of the storage holder with the air piston.

6. A storage holder according to claim 1, wherein the plug is provided at its exterior with a rim, and wherein the spacer rests on the rim.

7. A storage holder according to claim 1, wherein the pump section of the pump comprises:

a moveable operating part comprising a liquid piston, an air piston, and a nozzle for dispensing a liquid or foam;

a fixed part including the inlet tube fluidly connected to a liquid chamber; and an air chamber positioned around the liquid chamber, wherein the fixed part includes a cap through which the nozzle extends, with the cap having a larger cross section than the inlet tube, and with the cap having a side that rests on the spacer.

8. A storage holder according to claim 7, wherein the opening of the spacer encompasses part of the plug, part of the inlet tube, and part of the air chamber.

9. A fluid or foam dispenser comprising a housing and a storage holder according to any one of claims 1-8, wherein the storage holder is fastened to the housing with coupling means.

10. A method of disassembling a storage holder for placement in a liquid or foam dispenser, the storage holder comprising (i) a liquid reservoir having an opening and a plug provided in the opening, (ii) a pump including a pump section and an inlet tube extending from the pump section, with the inlet tube being fixed in the plug by a clamping connection, and (iii) a spacer including an opening for the inlet tube, with the spacer being positioned between the pump section and the plug so that a defined distance is provided between the pump section and the plug, and with the spacer being fixed at a position relative to the plug and relative to the pump only by the clamping connection between inlet tube and plug, the disassembling method comprising:

pulling the pump from the plug such that the spacer is obtained as a separate part without having to exert any additional force to separate the spacer from the pump and from the plug.

* * * * *